United States Patent [19]

Monser

[11] Patent Number: 4,779,064

[45] Date of Patent: Oct. 18, 1988

[54] RADIO FREQUENCY COAXIAL CABLE

[75] Inventor: George J. Monser, Goleta, Calif.

[73] Assignee: Raytheon Company, Lexington, Mass.

[21] Appl. No.: 32,665

[22] Filed: Apr. 1, 1987

[51] Int. Cl.[4] ..... H01P 1/22

[52] U.S. Cl. ..... 333/81 A; 333/243; 338/216

[58] Field of Search ..... 333/81 A, 243; 338/216; 174/126 R, 126 CP

[56] References Cited

U.S. PATENT DOCUMENTS 2,342,736 2/1944 Herzog et al. ..... 333/243 X
3,005,967 10/1961 Weinschel et al. ..... 333/81 A

FOREIGN PATENT DOCUMENTS 1591642 4/1970 Fed. Rep. of Germany ... 333/81 A
2030567 7/1982 Fed. Rep. of Germany ... 333/81 A

*Primary Examiner*—Paul Gensler
*Attorney, Agent, or Firm*—Richard M. Sharkansky

[57] ABSTRACT

A coaxial cable for coupling radio frequency (RF) signals therethrough with a predetermined, nominal attenuation comprising a center conductor selected to maintain the attenuation of the coaxial cable at substantially the nominal attenuation substantially independently of the frequency of the RF signals over a predetermined frequency range, such as from 2 to 18 GHz. In a preferred embodiment of the invention, the center conductor is selected having a nominal volume resisitivity ($\rho$) and a nominal permeability ($\mu$), with the volume resistivity-permeability product thereof substantially varying inversely with changes in frequency of RF signals coupled through the cable. With such arrangement, a lossy coaxial cable providing substantially constant attenuation over a broad range of frequencies, such as greater than three octaves, is provided having reduced size, complexity and VSWR from conventional lossy cable assemblies comprising a conventional coaxial cable coupled in series with an attenuator. Also, the frequency response attenuation characteristics of the coaxial cable are readily and consistently reproducible, thereby providing a plurality of such cables with "conformal" loss characteristics over the operating bandwidth to facilitate interchangeability of such coaxial cables. Further, the electrical lengths of a plurality of coaxial cables may be phase-matched to a relatively tight tolerance.

17 Claims, 3 Drawing Sheets

RADIO FREQUENCY COAXIAL CABLE

BACKGROUND OF THE INVENTION

The present invention relates to radio frequency (RF) coaxial cable, and more particularly to lossy RF coaxial cable having applications over wide frequency ranges.

As is known, in some applications radio frequency energy systems, such as radar systems, require the use of "lossy" RF cabling, that is, cables having a predetermined amount of attenuation in excess of a normal cable loss in order to provide buffering and reduce unwanted signal interactions. In one such application, the lossy cable is utilized as a "buffer" to attenuate and couple an RF signal to an amplifier to ensure the signal applied to the amplifier input is of sufficiently low power so that the amplifier operates in its linear range and does not become saturated. In another application, the lossy cable provides coupling between devices having relatively high voltage standing wave ratios (VSWR) to thereby "pad-down" the high VSWRs and reduce the VSWR product seen by an input signal applied to the assembly. Typically, such applications require the lossy RF cables to have nearly constant loss over a wide operating bandwidth, such as over more than one octave in frequency.

Conventional lossy RF cable assemblies for such applications comprise a coaxial cable in series with a discrete attenuator. The coaxial cable is of coneentional construction, having a center conductor comprising copper or silver-plated wire spaced from a conductive shield by dielectric material. The attenuator is selected to provide the cable assembly with a nominal attenuation (for example −3.0 dB) at the midband operating frequency of the assembly. Over the operating bandwidth, the loss provided by the attenuator remains substantially constant (i.e., flat), however, the cable loss typically changes with variations in frequency. Thus, the total attenuation characteristics of the cable assembly vary somewhat from the nominal attenuation (e.g. −3.0 dB) over the operating frequency bandwidth thereof, for example, by ±0.5 dB.

While such lossy cable assemblies are satisfactory in some applications, such cable assemblies are relatively large and bulky due to the presence of the attenuators therein and thus may be unsuitable for use in small RF systems or in RF systems where low weight is required (for example, in airborne applications). Also, such cable assemblies are relatively expensive since an attenuator is used with each RF cable. Further, a plurality of such lossy cable assemblies often have different frequency responses. That is, the attenuation characteristics over the operating frequency bandwidth of one such cable assembly may be substantially different from that provided by another such cable assembly, since the discrete components of such assemblies (e.g. the attenuators) typically have different frequency response characteristics. Thus, one of such lossy cable assemblies is not readily interchangeable with another one of such lossy cable assemblies and system adjustments typically are required when replacing such lossy cable assemblies to compensate for the different frequency responses thereof. Also, due to the presence of the attenuators in such cable assemblies, it is difficult to phase match the electrical lengths of two or more of such cable assemblies to tight tolerance (such as within a few degrees) over a wide frequency band (such as over more than one octave). Additionally, the attenuator increases the voltage standing wave ratio (VSWR) of the lossy coaxial cable assembly, thereby limiting the effectiveness of the lossy cable assembly in the aforementioned "pad-down" application.

SUMMARY OF THE INVENTION

Accordingly, it is an object of the present invention to provide a lossy coaxial cable assembly which does not require a discrete attenuator to provide the loss thereof. It is additionally an object of the present invention to provide a lossy coaxial cable assembly having consistently reproducible frequency response attenuation and phase characteristics over a relatively wide operating frequency bandwidth (such as greater than 3 octaves), thereby providing a plurality of such cable assemblies with substantially the same attenuation and phase characteristics over such frequency bandwidth. It is a further object of the present invention to provide a lossy coaxial cable assembly having a reduced VSWR.

In accordance with the present invention, a coaxial cable is provided for coupling radio frequency energy therethrough with a predetermined, nominal attenuation. The coaxial cable comprises a center conductor for providing the nominal attenuation and for maintaining said attenuation at substantially the nominal attenuation for radio frequency energy having greater than a three octave frequency range coupled through the coaxial cable. With such arrangement, a lossy coaxial cable having substantially constant loss over a wide range of frequencies is provided having reduced complexity, weight and cost from a conventional cable assembly which comprises an attenuator. Further, the frequency response attenuation characteristics of such coaxial cable are readily and consistently reproducible. Thus, a plurality of such lossy coaxial cables may be provided having "conformal" (i.e. substantially identical) loss characteristics over the operating bandwidth, thereby facilitating replacement and interchangeability of such plurality of lossy cables. Moreover, the electrical lengths of two or more of such coaxial cables may be phase matched to a relatively tight tolerance (such as plus or minus a few degrees), further adding to the interchangeability of a plurality of such lossy cables. Also, such cable assembly exhibits improved VSWR over conventional coaxial cable assemblies which comprise an attenuator.

In a preferred embodiment of the present invention, the center conductor is selected to have a nominal volume resistivity, $\rho$, and a nominal permeability, $\mu$, with the product thereof, $\mu\rho$, varying inversely with changes in frequency of the radio frequency energy coupled through the cable over a predetermined bandwidth, $\Delta f$. That is, $\Delta(\mu\rho)$ substantially equals $1/\Delta f$. Thus, frequency changes are substantially offset by a corresponding variation in the $(\mu\rho)$ product, thereby maintaining the attenuation of the coaxial cable substantially constant despite such changes in frequency.

BRIEF DESCRIPTION OF THE DRAWINGS

The foregoing features of the present invention and the advantages thereof may be fully understood from the following detailed description taken in conjunction with the accompanying drawings wherein.

DESCRIPTION OF THE PREFERRED EMBODIMENT

Figure 1:
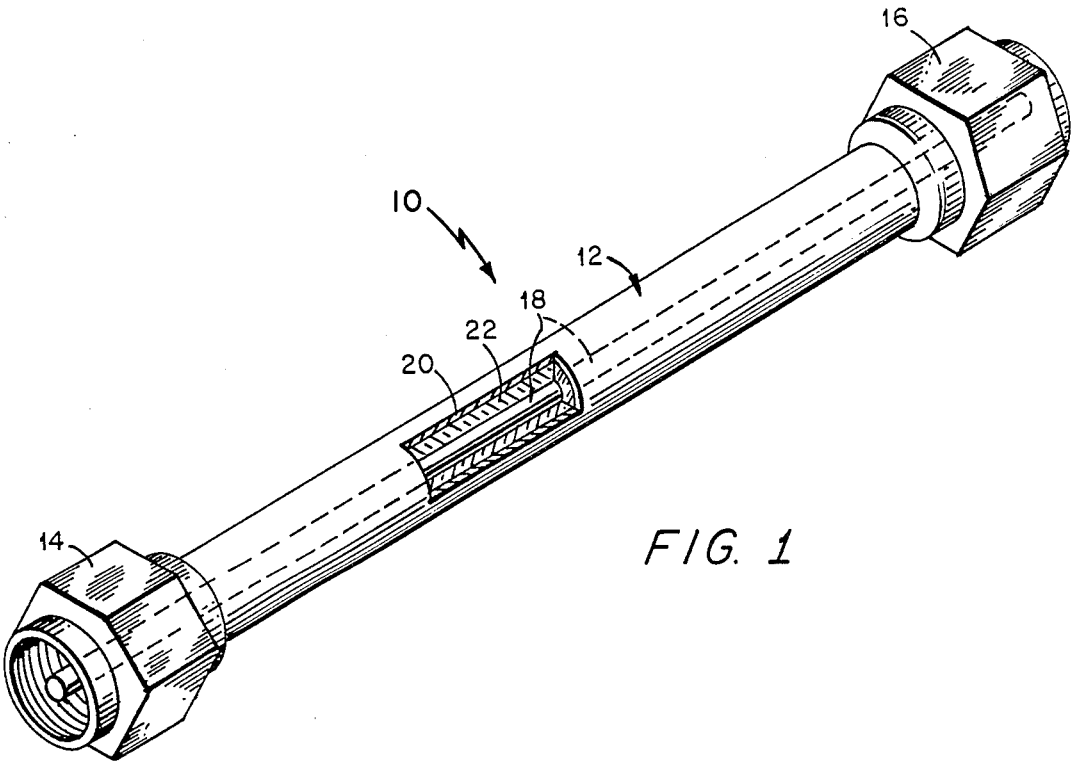
FIG. 1 is a perspective view, partially cut away, of a coaxial cable according to the present invention.

Referring now to FIG. 1, a lossy radio frequency (RF) coaxial cable assembly 10 according to the present invention is shown, it being noted at the outset that cable assembly 10 does not include a discrete attenuator as is provided in conventional lossy cable assemblies. Lossy RF coaxial cable assembly 10 comprises coaxial cable 12 having a conventional RF connector 14 attached to a first end thereof and a conventional RF connector 16 secured to a second end thereof for the propagation of radio frequency energy through coaxial cable 12 via first and second connectors 14, 16. Coaxial cable 12 comprises a center conductor 18 separated from a grounded outer conductor 20 by a dielectric 22, as shown in cross-section in FIG. 1. As discussed in detail hereinafter, center conductor 18 here comprises an electrically conductive material selected to provide cable 12 with a predetermined, nominal attenuation or loss and to maintain such attenuation at substantially the nominal attenuation over a predetermined frequency bandwidth, such as from substantially 2 GHz to 18 GHz (i.e. greater than three octaves) of RF energy coupled through coaxial cable 12.

As is known, and as discussed in *Microwave Transmission Design Data,* by Moreno, published by Dover Publications, Inc., 1948, paqes 62–65, the loss or attenuation presented by a coaxial cable to an RF signal coupled therethrough is in part a function of the center conductor loss of the coaxial cable. As discussed therein, the center conductor loss is represented by the following equation:

$$L_c = 13.6\frac{\delta\mu}{\lambda} \times \frac{1}{b}\left(1 + \frac{b}{a}\right)\frac{\sqrt{\epsilon_1}}{\ln\frac{b}{a}} \tag{1}$$

where: $\delta$ is the "skin depth" of the center conductor; $\mu$ is the permeability of the center conductor; $\lambda$ is the wavelength of the RF signal coupled through the coaxial cable; $\epsilon_1$ is the dielectric constant of the cable; $2b$ is cable; the outer diameter of the coaxial cable; and $2a$ is the diameter of the center conductor. Examination of equation (1) above reveals that for a given coaxial cable having a given dielectric constant, outer diameter ($2b$) and center conductor diameter ($2a$), the center conductor loss changes with wavelength ($\lambda$) according to the first term of such equation (13.6 ($\delta\mu/\lambda$). Thus, for the purpose of understanding the present invention equation (1) may be expressed as:

$$L_c = K\frac{\delta\mu}{\lambda} \tag{1a}$$

where K is a single cnstant representing the various constants in equation (1). As is known, the skin depth ($\delta$) of a center conductor is defined as the depth below the surface of the conductor at which the current density has decreased one neper below the current density at the surface. As discussed at Page 34 of the *Radio Engineers Handbook,* by F. E. Terman, published by McGraw-Hill Book Company, Inc., 1943, the skin depth, in centimeters (cm), may be represented by the following equation:

$$\delta = 5033\sqrt{\frac{\rho}{\mu f}} \tag{2}$$

where: $\rho$ is the volume resistivity of the center conductor; $\mu$ is the permeability of the center conductor: and f is the frequency of the RF siqnal coupled through the coaxial cable.

Substitution of equation (2) into equation (1) yields the following expression for the conductor loss of the cable:

$$L_c = K'\sqrt{\mu\rho f} \tag{3}$$

$$L_c = K'\sqrt{\mu\rho}\ \sqrt{f}$$

where K′ represents the various combined constants. Study of equation (3) reveals that the conductor loss of the coaxial cable remains constant over a range of frequencies ($\Delta f$) when the quantity ($\mu\rho$) changes inversely with frequency (f), that is, where:

$$\Delta(\mu\rho) = \frac{1}{\Delta f} \tag{4}$$

Thus, Applicant has found that selecting a conductor material having a permeability-volume resistivity product which substantially satisfies equation (4) as the center conductor for coaxial cable 12 will provide such cable 12 with a substantially constant center conductor loss substantially independently of changes in frequency of signals coupled through coaxial cable 12.

Here, an alloy of chromium, iron, silicon, manganese, aluminum, cobalt and carbon was selected as the center conductor 18 of coaxial cable 12. Such an alloy is commercially available under the name "KANTHAL-A1 TM" metal manufactured by MWS Industries of Westlake Village, Calif. 91362, and is approximately 22% chromium, 69% iron, and 8.8% of silicon, manganese, aluminium, cobalt and carbon. It is noted that other alloys could also be used in place of KANTHAL-A1 TM metal. One example is an alloy of 80% nickel and 20% chromium available a MWS650 TM metal manufactured by MWS Industries. Also, an alloy of 61% nickel, 15% chromium, and 24% iron manufactured by MWS Industries as product MWS675 TM metal may also be used. It is noted here that the resistivities of the above-identified alloys are between from $108\times10^{-6}$ ohms per $cm^3$ and $145\times10^{-6}$ ohms per $cm^3$. This is to be compared with a resistivity of about $1.7\times10^{-6}$ ohms per $cm^3$ for copper or silver-plated wire used as center conductors in conventional lossy cables. Thus, it is seen that center conductor 18 of coaxial cable 12 provides attenuation of RF energy coupled through cable assembly 10, thereby obviating the need for providing a discrete attenuator in such cable assembly.

Here, coaxial cable 12 (FIG. 1) comprises KANTHAL-A1 TM metal as center conductor 18 thereof and is semi-rigid cable, that is, outer conductor 20 forms the external sheathing of coaxial cable 12. Here, coaxial cable 12 has a length of approximately 6 inches, although it may be appreciated that such length is stated here for the purposes of illustration and the length of cable 12 will vary with the application thereof. Here, cable 12 has an outer diameter (*2b*) of substantially 0.119 inches—the same nominal outer diameter of conventional RG-141 semi-rigid coaxial cable. Thus, it may be app eciated that coaxial cable 12 is compatible with commercially available connectors for such standard RG-141 semi-rigid cable. That is, cable 12 does not require specially manufactured connectors 14, 16. Here, connectors 14, 16 are "male" SMA connectors manufactured by Omni-Spectra of Waltham, Mass., as part numbers 2001-5285-29. The KANTHAL-A1 TM metal center conductor 18 here has a diameter (*2a*) of 0.036 inches, selected, along with the dielectric constant of dielectric 22 (here, $\epsilon_1=2.07$), to provide cable 12 with a nominal impedance of 50 ohms.

Figure 2A:
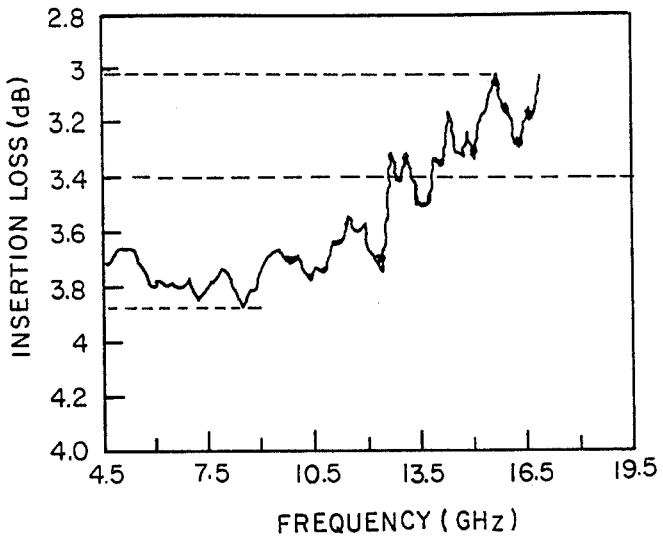
FIGS. 2A–2C are graphs plotting the attenuation vs. frequency characteristics of three cables of FIG. 1.
Figure 2B:
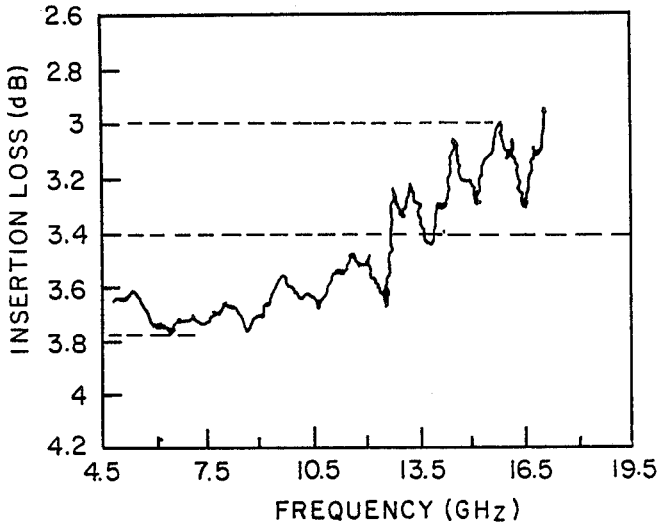
Figure 2C:
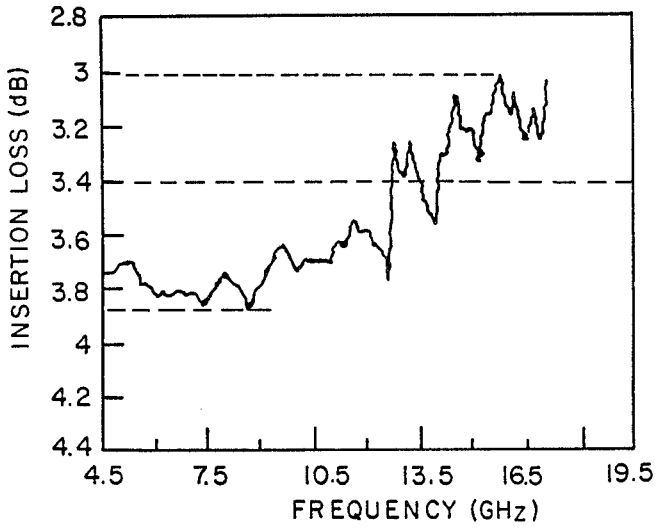

Referring now to FIGS. 2A–2C, graphs are shown of the attenuation-frequency responses of three coaxial cables fabricated according to the specifications discussed above (i.e., made with center conductors of KANTHAL-A1 TM). As shown, the attenuation or insertion loss of the cables over a frequency range of 4.5 to 16.5 gigahertz (GHz) is substantially 3.4 dB±0.5 dB. It is noted that such attenuation is achieved without a discrete attenuator in series with the coaxial cable. It is thus seen that the cable assembly 10 of the present invention is relatively simple to manufacture, is readily adaptable in existing systems since such cable 12 may be fabricated to receive standard, commercially available coaxial connectors, and is compact (due to the absence of a discrete attenuator), and thus may be implemented in small or airborne radio frequency systems.

Figure 3:
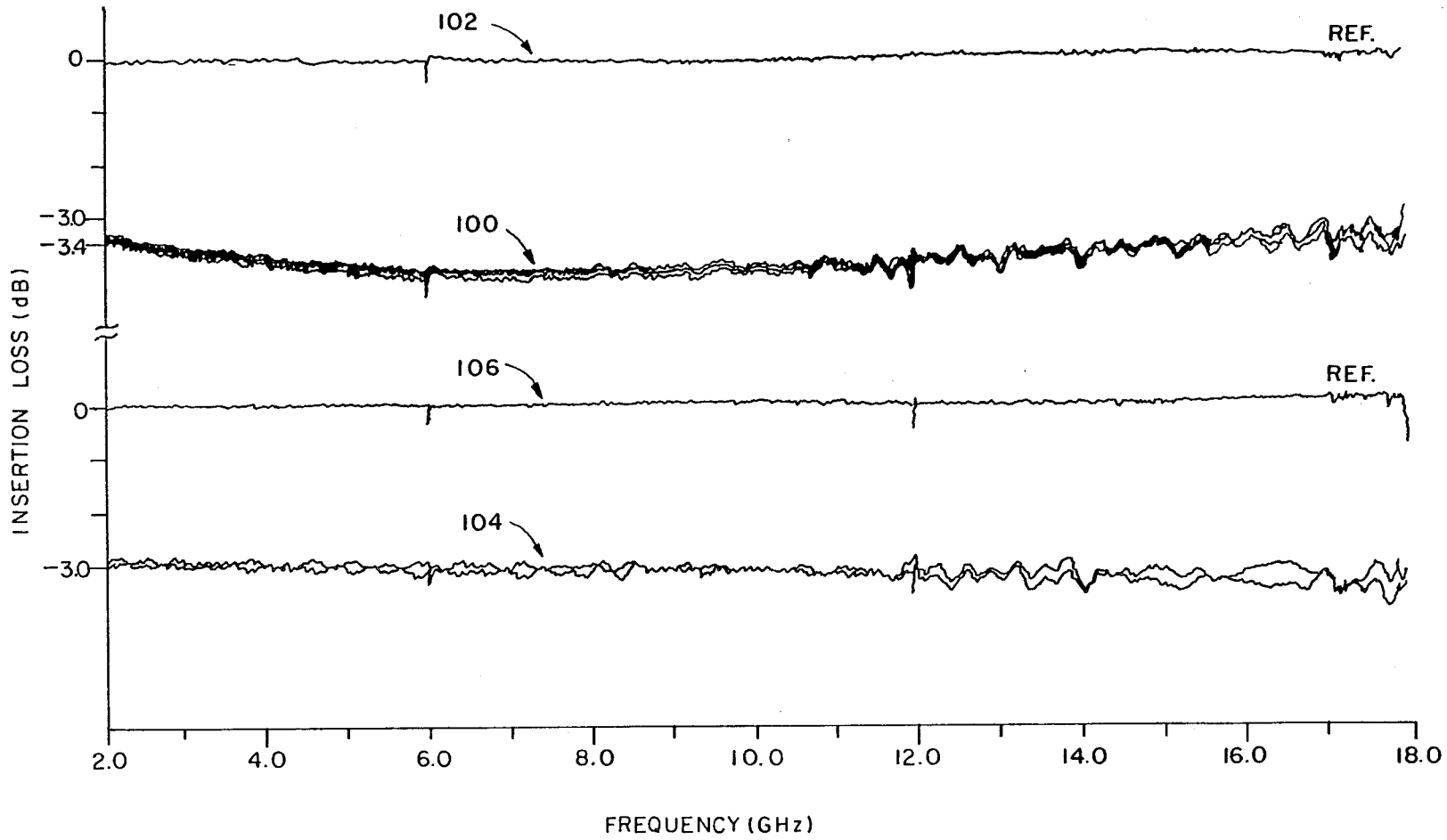
FIG. 3 is a graph comparing the attenuation vs. frequency characteristics of four cables of FIG. 1 and a pair of conventional, discrete attenuators.

An additional advantage of the present invention is that coaxial cable 12 has a readily reproducible frequency response (i.e. insertion loss vs. frequency characteristic) over a very wide frequency bandwidth compared with the insertion loss vs. frequency characteristics of conventional lossy coaxial cable assemblies comprising discrete attenuators. Referring now to FIG. 3, the insertion losses of four coaxial cables 12 of substantially the same length (here 6 inches) fabricated according to the specifications discussed above are compared with the insertion losses of two conventional 3 dB attenuators (here, model No. 4M manufactured by Weinschel Engineering of Gaithersburg, Md. 20760) for a frequency range of 2 to 18 GHz (i.e. greater than three octaves). The insertion losses of such four coaxial cables are plotted as trace 100 against a reference (0 dB) trace 102. As shown, such cables 12 have insertion losses of 3.4 dB±0.5 dB from reference trace 102 over the 2 to 18 GHz frequency range. Trace 104 plots the insertion losses of the pair of conventional 3 dB attenuators over such frequency range against reference trace 106. As shown in trace 104, the insertion losses of the pair of discrete attenuators vary widely from each other over the 2 to 18 GHz frequency range (up to 0.5 dB). Referring again to trace 100, it is again noted that such trace 100 represents the insertion loss of four separate coaxial cables 12 fabricated according to the present invention. It is further noted that the insertion losses of such four separate coaxial cables 12 are very similar—that is, such cables have "conformal" insertion loss characteristics. To put it another way, the insertion loss vs. frequency characteristics of the coaxial cable assembly 10 of the present invention are readily and accurately reproducible. A little thought thus reveals that one coaxial cable assembly 10 disposed in a system may be replaced by a second such coaxial cable assembly 10 of substantially the same length (e.g. 6 inches) with substantially no change in the insertion loss vs. frequency characteristics presented to the system by such second coaxial cable assembly 10.

Figure 4A:
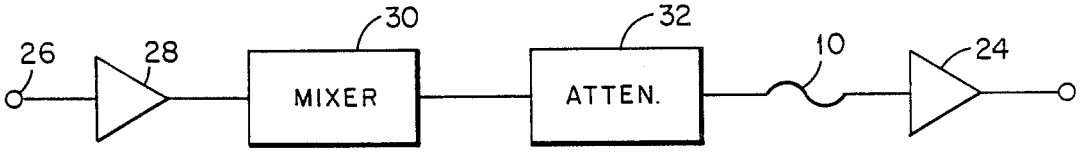
FIGS. 4A and 4B are block diagrams illustrating two applications of the coaxial cable of FIG. 1.

An illustrated application for the lossy RF coaxial cable assembly 10 of the present invention is schematically shown in FIG. 4A, where lossy cable 10 assembly is utilized to "buffer" RF signals coupled to amplifier 24. That is, an RF signal at input terminal 26 is amplified initially in amplifier 28 and coupled through, for example, mixer 30 and attenuator 32, which introduce losses in the signal. Lossy cable 10 attenuates the RF signal applied to the input of amplifier 24 by a predetermined amount (here, −3.4 dB±0.5 dB) to ensure that the signal applied to the input of amplifier 24 is of sufficiently low power to maintain amplifier 24 operating in the linear amplifying range thereof and prevent amplifier 24 from becoming saturated.

Figure 4B:
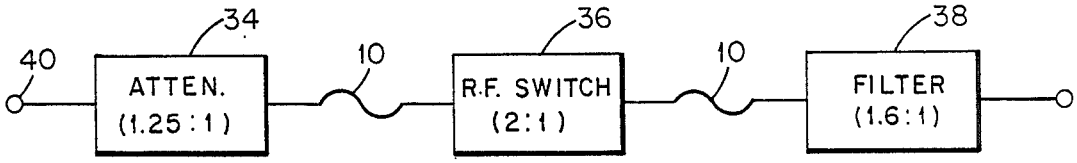

It has also been found that the VSWR of lossy coaxial cable assembly 10 is relatively low. For example, it has been found that the VSWRs of coaxial cable assemblies 10 fabricated according to the specifications discussed above are less than approximately 1.23:1 over the entire operating frequency band (here, between 2 and 18 GHz). This is to be compared with a conventional RF cable assembly comprising a conventional coaxial cable and a discrete attenuator, wherein the VSWR over such a large frequency band is typically quite high, for example, 1.8:1, due to the presence of the attenuator. An illustrative application in which such low VSWR of cable assembly 10 is advantageous is shown in FIG. 4B, wherein a pair of lossy coaxial cable assemblies 10 provide coupling between attenuator 34, RF switch 36, and filter 38 having relatively high VSWRs (for example, 1.25:1, 2.0:1, and 1.6:1, respectively). Without lossy cable assemblies disposed between devices 34, 36, 38, the VSWR seen by a signal at input port 40 is quite high (the product of the VSWR's of devices 34, 36, 38; here, 4:1) The relatively lossy (here, −3.4±0.5 dB), low VSWR (here, 1.23:1) cable assemblies 10 "pad-down" the VSWRs or devices 34, 36, 38 so that the total VSWR seen by a signal at input port 40 is substantially reduced (in this example to less than 2:1).

It is also noted that since lossy coaxial cable assembly 10 comprises only a coaxial cable 12 and associated connectors 14, 16, rather than a coaxial cable in series with a discrete attenuator as in conventional lossy cable assemblies, two or more of such coaxial cable assemblies 10 can be phase matched to relatively strict tolerances over the entire operating frequency band (here, from 2 to 18 GHz). For example, here the electrical lengths of the four coaxial cables traced in FIG. 3 are phase matched to ±6° over such frequency range.

Having described a preferred embodiment of the present invention, other embodiments may become apparent to persons of ordinary skill in the art. Therefore, it is felt that the scope of the present invention should be limited only by the scope of the appended claims.

What is claimed is:

1. A coaxial cable for coupling radio frequency energy therethrough, such radio frequency energy having a predetermined bandwidth, Δf, said coaxial cable comprising:

a center conductor, such center conductor being of a material having a nominal volume resistivity, $\rho$, and a nominal permeability, $\mu$, with the product, $\mu\rho$, of said permeability and volume resistivity varying substantially inversely with changes in the frequency of the radio frequency energy coupled through the coaxial cable over the predetermined bandwidth, $\Delta f$.

2. The coaxial cable recited in claim 1, such cable having a center conductor integrally formed from a material selected to couple radio frequency energy from a first point to a second point with a nominal attenuation of radio frequency energy of about 3.4 dB at a first frequency within the range of about 2 GHz to about 18 GHz and with an attenuation differing from the nominal attenuation by less than about 0.5 dB of radio frequency energy at frequencies in the range other than the first frequency.

3. The coaxial cable of claim 2 wherein said predetermined bandwidth, $\Delta f$, is greater than three octaves.

4. The coaxial cable of claim 2 wherein said predetermined bandwidth, $\Delta f$, extends from 2 GHz to 18 GHz.

5. A coaxial cable for coupling radio frequency energy therethrough, such radio frequency energy having a predetermined bandwidth, $\Delta f$, said coaxial cable comprising:

a center conductor, such center conductor being of a material having a nominal permeability, $\mu$, and a nominal volume resistivity, $\rho$, the product of the permeability and the volume resistivity changing by an amount $\Delta(\mu\rho)$ over the predetermined bandwidth, and wherein $\Delta(\mu\rho)$ substantially equals $1/\Delta f$.

6. The coaxial cable of claim 5 wherein said predetermined bandwidth, $\Delta f$, is substantially three octaves.

7. The coaxial cable of claim 5 wherein said predetermined bandwidth, $\Delta f$, extends from substantially 2 GHz to substantially 18 GHz.

8. The coaxial cable attenuator of claim 5 wherein the material of the center conductor comprises a mixture of chromium and iron.

9. The coaxial cable attenuator of claim 8 wherein the mixture comprises approximately 22% chromium and 69% iron.

10. The coaxial cable attenuator of claim 9 wherein the mixture additionally comprises silicon, manganese, aluminum, cobalt and carbon.

11. The coaxial cable attenuator of claim 5 wherein the center conductor material comprises a mixture of nickel and chromium.

12. The coaxial cable attenuator of claim 11 wherein the mixture comprises approximately 80% nickel and 20% chromium.

13. The coaxial cable attenuator of claim 5 wherein the center conductor comprises a mixture of nickel, chromium and iron.

14. The coaxial cable attenuator of claim 13 wherein the mixture comprises approximately 61% nickel, 15% chromium and 24% iron.

15. A coaxial cable wherein the center conductor is of a material comprising a mixture of approximately 61% nickel, 15% chromium and 24% iron.

16. A method of making a coaxial cable adapted to operate over a nominal operating bandwidth comprising the step of selecting a material for the center conductor of the coaxial cable having the property that the product of the volume resistivity and permeability of the selected material varies substantially inversely with frequency over the nominal operating bandwidth.

17. The coaxial cable made according to the method of claim 16.

* * * * *